United States Patent [19]

Cook et al.

[11] Patent Number: 4,808,061

[45] Date of Patent: Feb. 28, 1989

[54] SINGLE ARM BACKHOE

[76] Inventors: David K. Cook; Keith V. Cook, both of 4207 E. 12 Mile, Paris, Mich. 49338

[21] Appl. No.: 100,610

[22] Filed: Sep. 24, 1987

[51] Int. Cl.[4] ..... B66C 23/00; B66F 9/00

[52] U.S. Cl. ..... 414/695.7; 414/686; 414/723; 414/912

[58] Field of Search ..... 414/694, 719, 685, 686, 414/687, 695.7, 722, 723, 718, 912, 607

[56] References Cited

U.S. PATENT DOCUMENTS

| | | | |
|---|---|---|---|
| 2,788,906 | 4/1957 | Davis et al. | 214/138 |
| 2,815,137 | 12/1957 | Johnson | 214/138 |
| 3,149,737 | 9/1964 | Guinot | 414/694 |
| 3,412,880 | 11/1968 | Tweedale | 214/138 |
| 3,438,523 | 4/1969 | Vik | 414/607 X |
| 3,466,770 | 9/1969 | Morrison et al. | 414/694 X |
| 3,794,191 | 2/1974 | Kuhn | 414/685 X |
| 4,049,139 | 9/1977 | Stedman | 414/694 |
| 4,074,821 | 2/1978 | Long | 214/138 R |
| 4,122,959 | 10/1978 | Stedman | 414/694 |
| 4,142,642 | 3/1979 | Myers | 414/723 X |
| 4,150,504 | 4/1979 | Asche | 414/694 X |
| 4,318,661 | 3/1982 | Helm | 414/607 |
| 4,511,146 | 2/1986 | Eriksson | 414/687 |

FOREIGN PATENT DOCUMENTS 1288993 2/1969 Fed. Rep. of Germany ..... 414/719

OTHER PUBLICATIONS

J. I. Case Co., descriptive brochure on CASE Backhoes for 1835B-1845B Uni-Loader (Reg. TM); Four (4) pages.

American TRencher Inc., advertisement picture for "Bradco" (TM) Skid-Hoe (TM) attached to a John Deere loader, one (1) page.

*Primary Examiner*—Robert J. Spar
*Assistant Examiner*—Jennifer L. Doyle
*Attorney, Agent, or Firm*—Robert K. Wallor

[57] ABSTRACT

A backhoe arrangement is disclosed wherein a single dipper arm is adapted for operably, removably engaging a mounting bracket of a tractor mounted, cantilevered type of skip-loader boom arm assembly. The tractor provides support for the cantilevered load by reason that the boom arms are pivoted from a rear end of the tractor while the attached single-arm backhoe is operably deployed to the front of the tractor. The described embodiment provides for significantly reduced weight and complexity, thereby enabling the tractor to be driven during excavating operations. The dipper arm may be swung to positions nearly at right angles to the direction of travel of the tractor.

14 Claims, 3 Drawing Sheets

SINGLE ARM BACKHOE

BACKGROUND OF THE INVENTION

1. Field of the Invention

This invention relates to material handling boom assemblies and their associated vehicles wherein a material handling member is movable in various paths relative to the supporting vehicle. More particularly, this invention relates to power-driven shovels of a conventional loader type of backhoe mechanism mounted on a tractor or a similar vehicle wherein said mechanism may be greatly simplified.

2. Description of the Prior Art

Tractor mounted backhoe mechanisms are well known in the prior art. Representative of the many patents describing such mechanisms are U.S. Pat. No. 3,412,880 to R. L Tweedale and U.S. Pat. No. 4,074,821 to E. B. Long. Other such patents are common in the literature. Each has essentially the same arrangement comprising a bucket or scoop shovel pivotably supported by a dipper arm or dipper stick assembly which is in turn pivotably supported by a boom which is pivotably attached to a supporting bracket rigidly affixed to one end of a tractor or similar vehicle.

In general, each such arrangement includes a plurality of hydraulic cylinder and piston rod assemblies adapted for controllably driving the several aforementioned elements through their respective pivoting motions. While the exact nature of said motions may differ from one form of backhoe arrangement to another, they each perform substantially the same functions of dipping on appropriately positioned bucket into soil or other material to be excavated, said dipping action being generally in line with the longitudinal axis of the tractor, then actuating the boom and dipper arm so as to draw the bucket toward the tractor until it is full, then generally lifting the filled bucket by pivoting the boom and dipper arm until the filled bucket is above the level of the surrounding ground surface, then pivoting the boom to either side until the filled bucket is no longer over the area being excavated, whereat the bucket is actuated to cause the load to be dumped. Subsequently, the boom is repositioned over the excavation, the boom and dipper arm are appropriately re-extended, the bucket is appropriately positioned for digging, and a further excavating sequence is initiated. This process is repeated as often as may be necessary to accomplish the desired excavating task.

Typically, this type of mechanism is used in forming trenches and other relatively narrow excavations. Extended length excavations are generally formed by periodically repositioning the tractor.

Since conventional backhoe arrangements are commonly affixed to a bracket at one end of the tractor so as to extend outwardly therefrom, the wheels or tracks of the tractor located nearest this end of the vehicle act as a fulcrum about which the opposite end of the tractor may become elevated when the bucket is full and the boom and dipper arm are extended. Therefore, it is a common practice to provide an appropriate counterweight to the opposite end of the vehicle. Additionally, rigid outrigger supports, extending to the sides of the tractor and somewhat forward of the wheel axis, are affixed to the end of the vehicle near the boom supporting bracket.

A second type of material handling apparatus, commonly known as a front end loader or as a skip-loaded or as an UNI-LOADER, a Registered Trademark of J. I. Case Company, comprises a scoop or bucket attached to a vehicle such that it is disposed toward the front of the vehicle. This bucket may be appropriately elevated by boom arms and pivoted about a horizontal axis. The vehicle, with the bucket depressed and positioned to have its concave material holding cavity facing forward relative to the vehicle, may be driven forward into the material to be handled until the bucket is full. The bucket is then rotated about its horizontal axis so that the concave cavity is facing generally upward, and the bucket is then elevated to provide appropriate clearance while the vehicle is repositioned to a location whereat the material is to be off-loaded.

A particular form of such a skip-loader apparatus, specifically identifiable by a Registered Trademark of J. I. Case Company as an UNI-LOADER, provides for the bucket lifting mechanism to be in the form of a pair of booms stradling the body of the tractor from pivot points located near the rear of the tractor, with the distal ends of the booms providing means for attaching the bucket thereto at the front of the tractor. Each boom is caused to pivot in a vertical plane relative to the body of the tractor by a hydraulic cylinder and piston rod assembly, the pair being coupled to act in unison. One end of each cylinder and piston assembly is pivotably attached to the body of the tractor and the other end is pivotably attached to its corresponding boom near the distal end of said boom. The distal ends of each boom, being generally at the front of the tractor, include a depending member, respectively, disposed so as to extend generally downward substantially to the ground surface on which the tractor rests when the booms are in their normal lowered positions. The lower ends of these depending members contain attachment points, on a pivotable plate joining said lower ends, to which the bucket may be rigidly coupled. A second pair of hydraulic cylinder and piston rod assemblies, disposed typically to have one of the pair substantially adjacent, to each of said depending members, are pivotably attached between the distal ends of the booms and corresponding brackets affixed to said pivotable plate. Operation of this second pair of cylinder and piston assemblies, in unison, will cause the pivotable plate to rotate about a substantially horizontal axis, thereby causing rotation of the attached bucket about said horizontal axis. Appropriate additional structural bracing may be incorporated to extend transversely between the booms so as to provide necessary strength to the apparatus.

To further orient the reader as to the details of such examples of the prior art, reference is made to the literature describing the Uni-Loader (A Registered Trademark of J. I. Case Company) Skid Steers, models 1835B and 1845C and the corresponding backhoe attachments for said devices, both manufactured by the J. I. Case Company, of Racine, Wis. As can be observed from said literature, when the backhoe attachment is included, the straddling booms serve no function. Moreover, the stability requirements of such a use of the apparatus necessitates the use of outriggers which precludes any relocation operation of the tractor while the backhoe is in use. Improvement in operational capability, along with a simplification of design, are envisioned by the herein invention.

SUMMARY OF THE INVENTION

Accordingly, it is an object of the present invention to provide an apparatus capable of performing backhoe type excavation operations without resort to the use of outriggers for stability.

It is a further object of the present invention to provide a backhoe apparatus comprising a single dipper arm and bucket assembly adapted to be readily attached to an existing front end loader mechanism mounted on a tractor.

It is another object of the present invention to provide a backhoe apparatus, in combination with an existing self-propelled front end loader apparatus, that utilizes cantilevering of the backhoe load from the rear of said self-propelled apparatus in a manner such that said self-propelled apparatus may be readily moved on its wheels or tracks while excavating or carrying a loaded bucket.

A further object of the present invention is to provide a backhoe apparatus, in combination with an existing self-propelled front end loader apparatus, which utilizes the wheel or track base of said self-propelled apparatus as a portion of the support for a cantilevered backhoe operating arrangement.

Another object of the present invention is to provide a backhoe apparatus having a significantly reduced weight as compared to prior backhoe arrangements.

Yet another object of the present invention is to provide a backhoe apparatus capable of being pivotably disposed about a vertical axis relative to a self-propelled tractor so as to enable dumping a loaded bucket substantially adjacent either side of said tractor supporting said backhoe apparatus, said unloading capability including the capability of unloading into the bed of a second vehicle positioned along the side of said backhoe-equipped tractor.

It is yet a further object of the present invention to provide a backhoe apparatus which is readily removable from and replaceable onto a standard front end loader equipped tractor.

It is yet another object of the present invention to provide a backhoe apparatus, adapted to be attached to a standard front end loader equipped tractor, which has significantly reduced costs of manufacture while retaining the operational capabilities of prior art backhoe arrangements.

These, and further objects, features and advantages of the present invention which may become evident through the detailed description and claims set forth hereinbelow, are provided by a backhoe apparatus comprising a bucket pivotably affixed to a distal end of a cantilevered dipper arm pivotably supported from a boom frame of a self-propelled, front end loader equipped, tractor. In the following discussion, the surfaces of the wheels or tracks upon which the tractor rests are used to define a plane which is designated as horizontal for reference of the definition of other planes and axes used for descriptive purposes. Considering the type of tractor having a pair of boom arms straddling the body thereof, such equipment generally has said pair of boom arms disposed to pivot in parallel vertical planes about a horizontal axis through a portion of a frame of said tractor near a first end thereof designated as the rear end. Often, said boom arms are configured, in a "rest" position, to originate from brackets rigidly affixed to and extending substantially upwardly from the rear of said tractor at either side thereof, the upper ends of said brackets defining said pivot axis, and then to extend slopingly downward and forward to points substantially over the front end of the tractor so as to be in a vertical plane passing transversely through the front end of the tractor orthogonally to the direction of travel capability thereof. The boom arms may be caused to pivot in a controlled manner about said axis by operation of hydraulic cylinder and piston rod assemblies acting between a second pivot axis on the frame of the tractor and pivotable bracket attachments on the sloping segments of the boom arms. In the usual arrangement, each of said boom arms has an associated boom arm cylinder and piston assembly, which are controlled to act in unison.

Each boom arm has an associated downwardly directed boom extension member rigidly depending from the distal end thereof. These boom extension members have a vertical extent such that their respective free ends are substantially at ground level when the boom arms are in their "rest" position. Said free ends are joined by a substantially horizontal, rigidly attached, cross member to which is attached a transverse bracket which is adapted to pivot, relative to said cross member, about a substantially horizontal axis along the extent of said cross member between the boom arms. A second pair of hydraulic cylinder and piston rod assemblies are pivotably coupled between brackets rigidly affixed to the boom arms defining a horizontal axis located generally at the intersection of the distal ends of the boom arms and their corresponding boom extension members, and brackets attached to the pivoting transverse bracket. Operation of said boom extension cylinder and piston assemblies, in unison, causes said transverse bracket to pivot controllably about its horizontal axis.

In its intended use as a front end loader, the above-summarized apparatus includes a forward facing scoop bucket which is rigidly attached to the transverse bracket in a removable manner. Operationally, the tractor, with the boom arms lowered and the scoop having a lower surface substantially adjacent and parallel to the local ground surface, thereby forming a forwardly directed concave receptacle for material, is driven in a forward direction so that the scoop fills with material from an appropriately placed pile. In boom extension cylinder and piston assemblies are then actuated so that the transverse bracket and the attached bucket are rotated about the horizontal axis, with the front end of the scoop moving in an upward direction until the load of material is captured within the concave receptacle formed by the scoop. The boom arm cylinder and piston assemblies may then be actuated to elevate the distal ends of said boom arms, which in turn elevates the loaded scoop. Some adjustment may be necessary in the rotational position of the transverse bracket and the scoop during elevation of the boom arms to avoid spilling a portion of the load from the scoop.

The tractor may then be driven to a location whereat the material within the scoop is to be unloaded. In the event that the load is to be placed in the bed of a truck, the boom arms are elevated appropriately to clear the side of the truck, the tractor is driven to a position whereat the scoop is appropriately positioned over the bed of the truck, and the boom extension cylinder and piston assemblies are actuated to tip the scoop into a forwardly downward orientation, thereby dropping the material from the scoop into the truck bed. If the load is to be deposited at a location substantially at ground level, the boom arms need not be elevated more than necessary to provide clearance for the scoop during driven translation of the tractor.

By removing the scoop from the transverse bracket and replacing it with the apparatus of the present invention, the above-described tractor may be converted into use as a backhoe. The apparatus of the present invention is attachable to the transverse bracket by a matching transverse support bracket which envelops an upper surface, a lower surface and a forward surface of the boom assembly transverse bracket. Appropriate pin holes or other means are available to lock the matching bracket to the transverse bracket.

The backhoe assembly comprises the aforesaid matching transverse support bracket, a forward directed dipper arm support bracket and pivot assembly rigidly affixed to the matching bracket, a dipper arm pivotably attached at one end thereof to the pivot assembly so as to provide rotation about the pivot axis in a plane parallel to the upper surface of the boom transverse bracket, an excavating bucket pivotably attached to the distal end of the dipper arm so as to rotate about a substantially horizontal transverse axis, a bucket position controlling hydraulic cylinder and piston rod assembly pivotably attached between a bracket on an upper surface of the dipper arm and a bracket attached to the bucket, and a dipper arm swinging hydraulic cylinder and piston rod assembly rigidly attached to the matching transverse support bracket, said piston terminating in a rack gear engaged with a pinion gear rigidly coupled to the shaft about which the dipper arm swings, which shaft is in turn rigidly coupled to said dipper arm. Necessary hydraulic lines are appropriately passed from the tractor to the two hydraulic cylinders such that the standard controls of the tractor may differentiably control the actuation of the dipper arm swinging cylinder and piston assembly and the bucket positioning cylinder and piston assembly.

The bucket of the backhoe is mounted so that it provides a generally downwardly directed concave material holding cavity when the apparatus is in an excavating orientation. By a combination of appropriate boom elevation and actuation of the boom extension cylinder and piston assemblies to cause a forwardly downward deflection of the transverse bracket and the attached dipper arm assembly, the bucket may be caused to dig into the ground, typically along a line oriented in the direction in which the tractor would progress if driven. Further operation of the boom and dipper arm in this manner can draw the bucket downwardly and toward the tractor until the bucket is filled. Operation of the bucket positioning cylinder and piston can then position the bucket such that the excavated material is substantially retained therein. Further elevation of the booms and deflection of the dipper arm can then be accomplished in a manner such that the loaded bucket is raised above the level of the surrounding ground surface. The dipper arm swinging cylinder and piston assembly acting between the matching transverse support bracket and rack gear may then be actuated so as to cause the rack gear to be translated to a substantially horizontal direction, which, by the engagement between the rack gear and the pinion gear, causes the pinion gear to rotate. The pinion gear, being rigidly attached to the dipper arm by way of the shaft forming the pivot axis supporting the dipper arm, thereby rotates the dipper arm. When the desired angle of rotation to the side of the tractor has been achieved, the bucket positioning cylinder and piston assembly is actuated to cause the bucket to tilt downward thereby dumping the load of excavated material. and extension of the dipper arm enable the bucket to be raised sufficiently to clear the side panels of conventional trucks so that the excavated material may be dumped therein. The horizontal rotational capability of the dipper arm relative to the longitudinal axis of the tractor enables the loaded bucket to be emptied to either side of the tractor at locations substantially adjacent the position of the tractor. Additionally, by having the loaded bucket effectively cantilevered from the rear of the tractor, the tractor may be driven while the bucket is loaded, or even repositioned while the bucket is engaged with the ground in an excavating mode.

BRIEF DESCRIPTION OF THE DRAWING

In the accompanying drawing forming a part of the specification, and in which like numerals are employed to designate like parts throughout the same.

DETAILED DESCRIPTION OF THE PREFERRED EMBODIMENT

Figure 1:
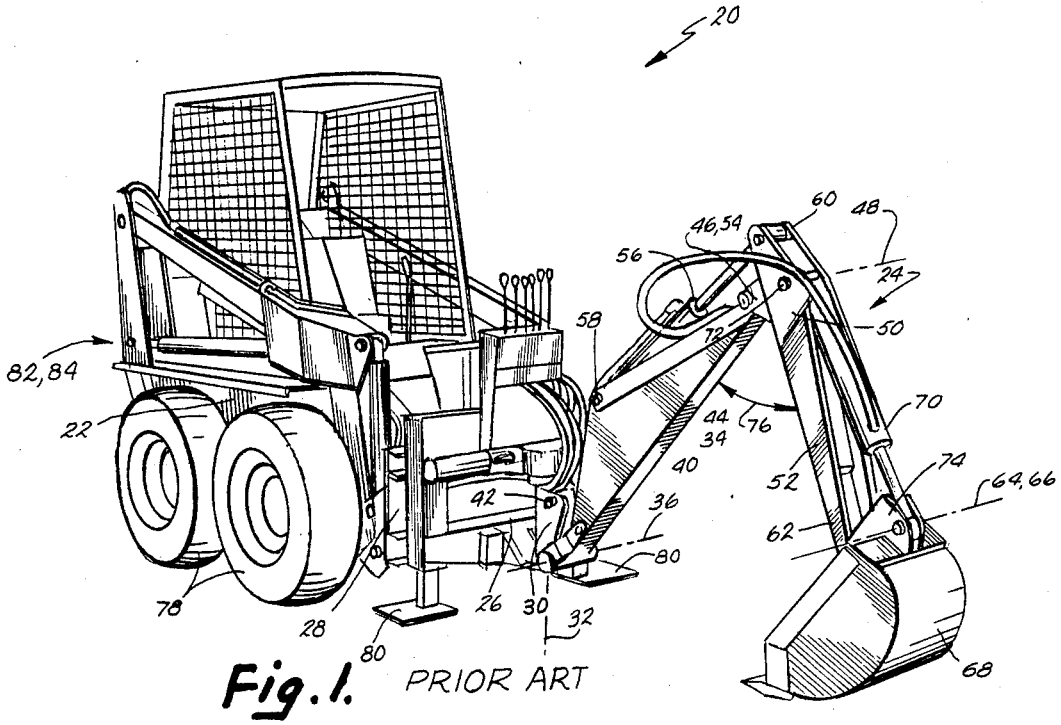
Fig. 1. PRIOR ART
FIG. 1 is a perspective view of a tractor-mounted backhoe arrangement typifying the state of the prior art of knowledge.

In order to better understand the improvements provided by the principal embodiment of a backhoe mechanism in accordance with the present invention, it is useful to provide a brief description of a typical backhoe arrangement as illustrated in the prior art. Therefore, referring first to FIG. 1, a typical backhoe arrangement adapted from the prior art is indicated generally at 20. A tractor 22, serving both as a prime mover and as a power source for a backhoe assembly 24, is equipped with at least one mounting bracket 26 for attaching the backhoe mechanism, rigidly affixed to a first end 28 of the tractor 22, usually designated to be the front end 28 of the tractor 22. Said mounting bracket 26 provides support for the backhoe assembly 24. A matching bracket 30 is pivotably coupled to said mounting bracket 26 such that the matching bracket 30 may rotate with respect to said mounting bracket 26 about a generally vertically oriented axis 32. The matching bracket 30 also provides a pivotable support for a boom arm 34 whereby a pivot axis 36, oriented to be generally horizontal and transverse to the extent of said boom arm 34, passes through one end 38 of said boom arm 34 and through said matching bracket 30.

At least one hydraulic cylinder and piston rod assembly 40 is pivotably coupled between a second bracket 42 rigidly affixed to said matching bracket 30 and a bracket 44 rigidly affixed to said boom arm 34 proximate to a distal end 46 thereof. Hydraulic lines are passed from a standard hydraulic system on said tractor 22 to said at least one hydraulic cylinder 40 such that operation of a control on said tractor 22 can cause the boom arm 34 to be controllably pivoted upwardly and downwardly about the horizontal pivot axis 36 at said matching bracket 30.

Means for controllably pivoting the matching bracket 30 about its vertically oriented pivot axis 32 are coupled between said matching bracket 30 and said tractor 22. A separate control, located on said tractor 22, operates such sideways swinging motion of said boom arm 34.

A further pivot axis 48, oriented in a substantially horizontal plane and directed transverse to the extent of said boom arm 34, is located to pass through said boom arm 34 near its distal end 46. A first end 50 of a dipper arm 52 is pivotably supported from said boom arm 34 by a shaft 54 passing along said plvot axis 48. A dipper arm actuating hydraulic cylinder and piston rod assembly 56 is pivotably coupled between a second bracket 58 rigidly affixed to the distal end 46 of said boom arm 34 and a bracket 60 rigidly affixed to said dipper arm 52 at a location proximate to the distal end 62 of said dipper arm 52. Appropriate hydraulic lines are passed from the tractor 22 hydraulic system to the cylinder of said assembly 56 to enable the dipper arm 52 to be controllably pivoted with respect to said boom arm 34 in an upwardly and downwardly oriented direction. It is to be noted that the pivoting motions of both the boom arm 34 and the dipper arm 52 are accomplished in a substantially vertical plane such that an imaginary line from the matching bracket vertical pivot 32 to the distal end 62 of said dipper arm 52 is always contained in said imaginary vertical plane. The aforementioned swinging motion of said boom arm 34 causes said imaginary vertical plane to be rotated about said vertical pivot axis 32, said imaginary plane remaining vertical throughout such motion.

The distal end 62 of said dipper arm 52 is provided with a generally horizontal pivot axis 64 and shaft 66 oriented transversely to the extent of the dipper arm 52. A scoop or bucket 68, serving as an excavating implement, is attached thereto so as to be capable of rotating about said axis 64 and within the aforesaid imaginary plane. A bucket positioning hydraulic cylinder and piston rod assembly 70 is pivotably coupled between a further bracket 72 rigidly affixed to the distal end 62 of said dipper arm 52 and a bracket 74 rigidly affixed to said bucket 68. Appropriate hydraulic lines are coupled between said cylinder 70 and the tractor 22 hydraulic system to enable the controllable pivoting of said bucket 68.

The bucket 68 is typically disposed to provide a downwardly directed concave material receptacle when the boom arm 34, dipper arm 52, and bucket 68 are placed, by appropriate operation of the controls on the tractor 22, into their excavating position. In such a configuration, the boom arm 34 is, in general, in a substantially lowered position, and the dipper arm 52 is, in general, in a raised position relative to said boom arm 34, thereby forming a downwardly directed obtuse angle 76 between the boom arm 34 and the dipper arm 52, which configuration provides a substantially maximum extension of the combination outwardly from the tractor 22. tHE illustration of FIG. 1 shows partial extension of the boom arm 34 and the dipper arm 52.

Actuation of the dipper arm cylinder and piston assembly 56 in a manner tending to lower the distal end 62 of said dipper arm 52 causes the bucket 68 to be forced downward into the material to be excavated. As the bucket 68 is so engaged with the material, the bucket positioning cylinder and piston assembly 70 is actuated so as to cause the open end of the concave cavity formed by the walls of the bucket 68 to be rotated toward the tractor 22. The boom arm cylinder and piston assembly 40 and the dipper arm cylinder and piston assembly 56 are then controllably actuated, in an appropriate combination thereof, so as to draw the bucket 68 toward the tractor 22 until it is filled with material. The bucket 68 may then be further rotated toward the tractor 22, by means of appropriate actuation of the bucket positioning cylinder and piston assembly 70, so that the bucket 68 will be oriented so as to tend to hold the material gathered within said bucket 68 by gravity. The boom arm 34 and the dipper arm 52 are then pivoted in combination so as to elevate the bucket 68 from the excavation to a height sufficient to clear the adjacent surrounding ground surface. The boom arm 34 may then be swung about its vertical axis 32 so that the bucket 68 assumes a position to one side or the other of the excavation by a distance sufficient to enable offloading of the material within the bucket 68 without having said material reenter the excavation. At this position, the bucket positioning cylinder and piston assembly 70 is actuated so as to rotate the open end of the bucket 68 downwardly and away from the tractor 22 until the material within the bucket 68 is dumped therefrom. The boom arm 34 may then be swung back into alignment with the excavation, and the boom arm 34, the dipper arm 52, and the bucket 68 can be appropriately repositioned to enable a further excavation operation to be initiated as outlined hereinabove.

In view of the cantilevered position of the bucket 68 at the distal end 62 of the combined boom 34 and dipper arms 52, from the attachment to the tractor 22 at the mounting bracket 26, a significant moment of torque acting in a vertical plane can be produced about a fulcrum established by the tractor supporting wheels 78 proximate to the end of the tractor 22 from which the backhoe 24 extends. Thus, additional support, in the form of outriggers 80, are included in much of the prior art. The outriggers 80 are rigidly affixed to the tractor 22 at or near the front end 28 thereof, proximate to the mounting bracket 26. Said outriggers 80 are configured to extend outwardly from the sides of the tractor 22, and to then depend therefrom to contact the surface of the ground. Said outriggers 80 may be removed to enable the tractor 22 to be driven. Additional stability against the aforesaid longitudinal tipping moment is provided to the tractor 22 by the inclusion of an appropriate counterweight 82 on the rear end 84 of said tractor 22.

Figure 2:
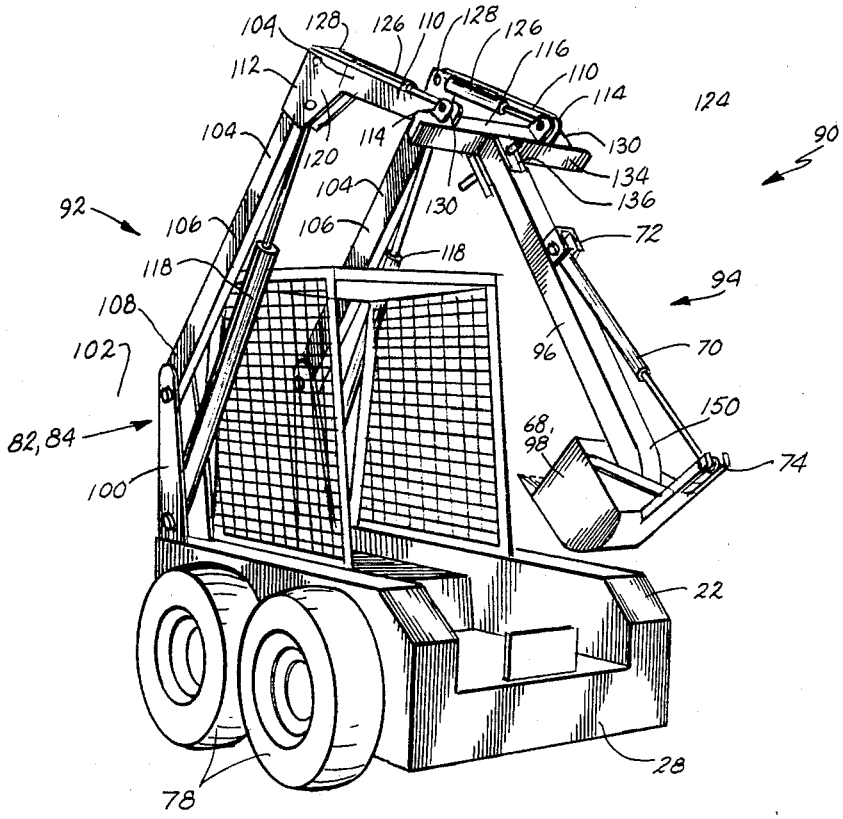
FIG. 2 is a perspective view of a tractor-mounted backhoe arrangement in accordance with the present invention.

Referring next to FIG. 2, a backhoe system in accordance with the present invention is illustrated generally at 90. A tractor 22, having a generally elevated cantilevered boom assembly 92, supported at a first, or rear, end 84 of tractor 22, is adapted to receive a single-arm backhoe assembly 94, comprising a dipper arm 96, a bucket 68, appropriate pivot means enabling rotation of the dipper arm 96 in a vertical plane, appropriate means enabling rotation of the bucket 68 in the same vertical plane, appropriate pivot means enabling a substantially horizontal swinging of the dipper arm 96 and bucket 68 combination relative to the orientation of the tractor 22, means for supporting said backhoe assembly 94 on said boom assembly 92, and means for controllably actuating each of said pivoting motions.

Considering first those elements of the system relating directly to the tractor 22, and which enable said tractor 22 to be used as a loader when appropriately equipped with a scoop, a boom assembly 92 is pivotably attached, by a pair of generally upright bracket 100, to said tractor 22, so as to be capable of pivoting about a substantially horizontal axis and shaft 102 passing transversely through or above a first, or rear, end 84 of the tractor 22. The boom assembly 92 is configured to include a pair of boom arms 104, disposed to straddle the tractor 22. Each boom arm 104, in a "rest" position, is supported by its corresponding bracket 100 and consists of a cantilevered, substantially horizontal segment 106 pivotably coupled at a first end 108 thereof to the upright bracket 100 and having a length substantially equivalent to the length of the tractor 22, and a depending boom arm extension member 110 rigidly coupled to the forward, or distal end 112 of the horizontal segment 106 and having a downward extent approximating the elevation from the ground surface of the distal end 112 of the horizontal segment 106. The distal, or lower, ends 114 of the boom arm extension members 110 are joined by a substantially horizontal transverse cross member 116 rigidly affixed therebetween. Each of said boom arms 104 has a boom arm hydraulic cylinder and piston rod assembly 118 associated therewith. Said boom arm cylinder and piston assemblies 118 are pivotably coupled between brackets rigidly affixed to corresponding sides of said tractor 22 proximate to said supporting pivot axis 102, which may be said brackets 100, and brackets 120 respectively rigidly affixed to the corresponding boom arms 104 near the distal ends 112 of their respective horizontal segments 106. The tractor 22 is provided with an appropriate hydraulic system and controls to enable actuation of said boom arm cylinder and piston assemblies 118 in unison so as to cause the boom arms 104 to rotate in substantially vertical parallel planes.

A substantially horizontal transverse mounting bracket 122, extending across the front end 28 of the tractor 22, is pivotably coupled to the aforesaid cross member 116 so as to enable rotation of the mounting bracket 122 about a substantially horizontal axis 124 extending transverse to the tractor 22. Said mounting bracket 122 has an extent substantially equivalent to the span between the boom arms 104, and has provision for the mounting of various implements, such a scoop or the herein backhoe assembly 94. A pair of boom extension hydraulic cylinder and piston rod assemblies 126 are pivotably coupled between a pair of brackets 128 respectively rigidly affixed to their corresponding boom arms 104 near the intersections between the respective horizontal segments 106 and their corresponding depending extension members 110 and a pair of brackets 130 rigidly affixed to said pivotable mounting bracket 122 near corresponding ends thereof. The tractor 22 hydraulic system and controls provide for the controllable rotation of the mounting bracket 122 relative to the cross member 116.

In one form of the above-described apparatus, a scoop (not illustrated) may be attached to said mounting bracket 122 by appropriate pin or bolt means, and the resulting combination may be used as a front end loader. The elevation of the boom arms 104 governs the height of which the scoop is carried, while actuation of the boom extension cylinder and piston assemblies 126 governs the orientation of the scoop into scooping, carrying, and dumping positions.

Figure 3:
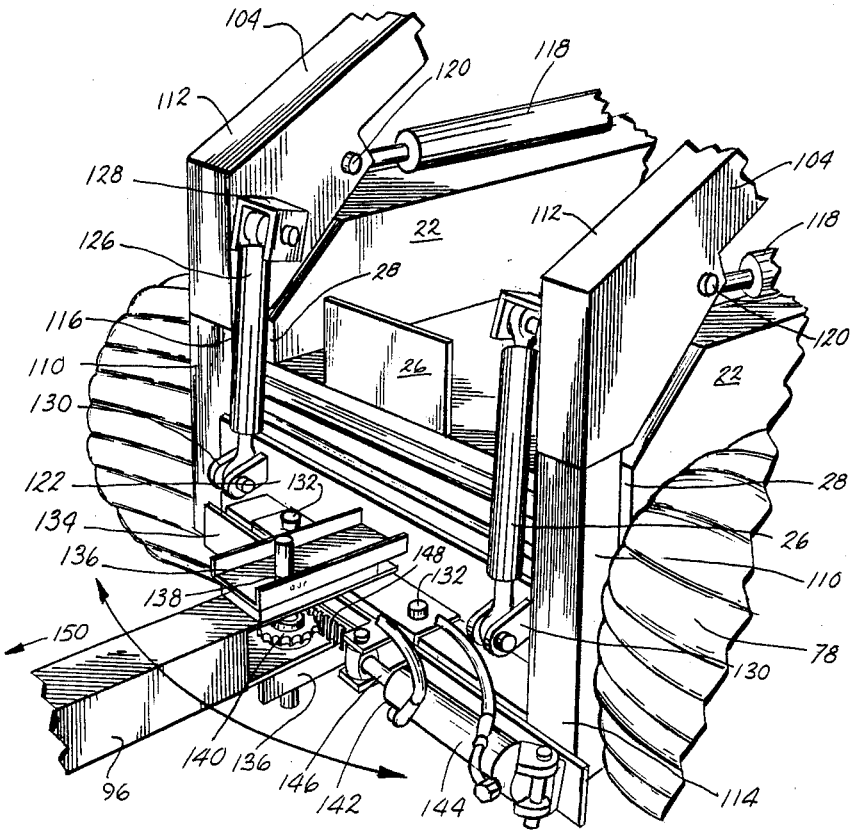
FIG. 3 is a partially cut-away perspective view of a segment of the present invention illustrating the method of mounting the backhoe assembly onto the tractor, and the manner of providing for lateral swinging of a dipper arm.
Figure 4:
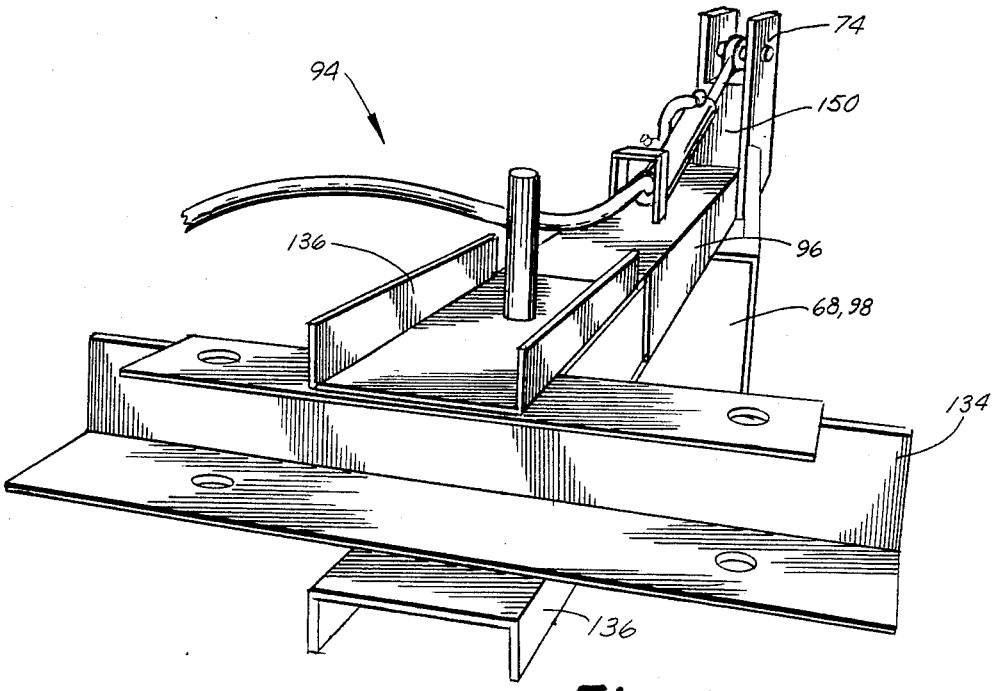
FIG. 4 is a perspective view of a backhoe assembly in accordance with the present invention, as viewed from the mounting end thereof along its extent.

Referring next to FIGS. 3 and 4, for use as a backhoe in accordance with the present invention, a backhoe assembly 94 is mounted to said mounting bracket 122 in lieu of the aforesaid scoop by appropriate pin or bolt means 132. Said backhoe assembly 94 is provided with a matching bracket 134 having a horizontal extent substantially equivalent to that of said mounting bracket 122. The matching bracket 134 is configured so as to substantially envelop said mounting bracket 122 on three sides thereof such that the mating between the matching bracket 134 and the mounting bracket 122 forms a substantially rigid combination. On the obverse side of the matching bracket 134, the side located away from said mounting bracket 122 and the tractor 22, a dipper swing pivot bracket 136 is rigidly affixed. Said dipper swing pivot bracket 136 supports a first end of a dipper arm 96 in a manner enabling rotation of the dipper arm 96 about a substantially vertical axis 102. A shaft 102, passing along said pivot axis 102 through said dipper swing pivot bracket 136 and said dipper arm 96, is rigidly attached to said dipper arm 96 so as to rotate therewith, while being free to rotate within axial holes 138 in said dipper swing pivot bracket 136. A circular pinion gear 140, coaxially located with respect to said shaft 102, is rigidly coupled to said shaft 102 and dipper arm 96 so as to rotate therewith. A dipper swing hydraulic cylinder and piston rod assembly 142 is affixed to said matching bracket 134 such that the cylinder 144 is rigidly located relative thereto while the piston 146 is free to move in a substantially horizontal direction parallel to the extent of said matching bracket 134 between said boom arm extension members 110. The piston 146 may be formed to include, in its length protruding from its cylinder 144, a rack gear 148. In another embodiment, the rack gear 148 may be affixed to the end of the piston 146 as an extension thereof. The relative mounting positions of said rack gear 148 and said pinion gear 140 are such as to cause a matching engagement therebetween. Controllable actuation of the dipper swing cylinder and piston assembly 142, utilizing the hydraulic system and controls of the tractor 22, causes the rack gear 148 to move in a generally horizontal direction with respect to the pinion gear 140, thereby causing the pinion gear 140, and thus the attached shaft 102 and dipper arm 96, to rotate or swing.

The distal end 150 of the dipper arm 96 pivotably supports an excavating bucket 68 in the manner described earlier herein in relation to the prior art arrangement. The similarity extends to the placement and operation of a bucket positioning hydraulic cylinder and piston rod assembly 70.

Figure 5:
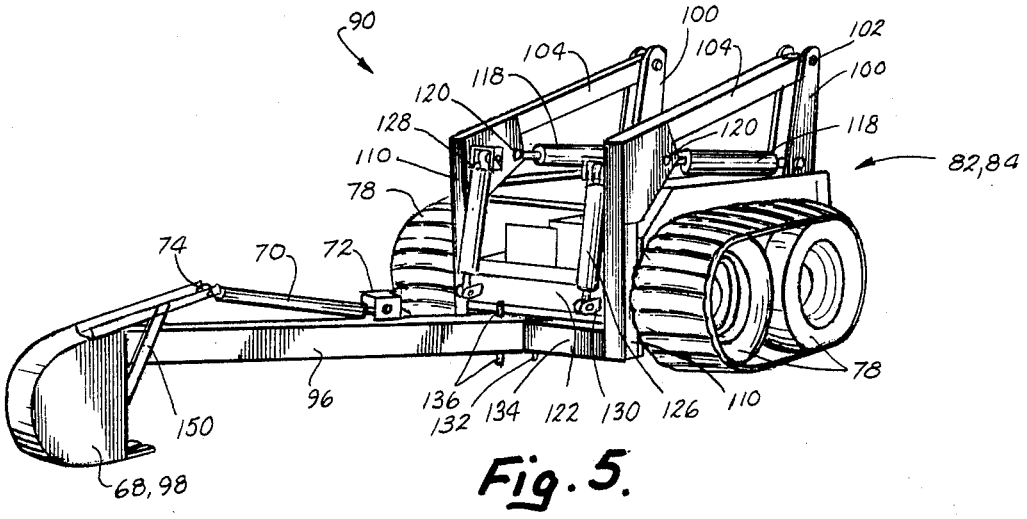
FIG. 5 is a perspective view of a tractor-mounted backhoe arrangement in accordance with the present invention, illustrating a typical intermediate excavating position.
Figure 6:
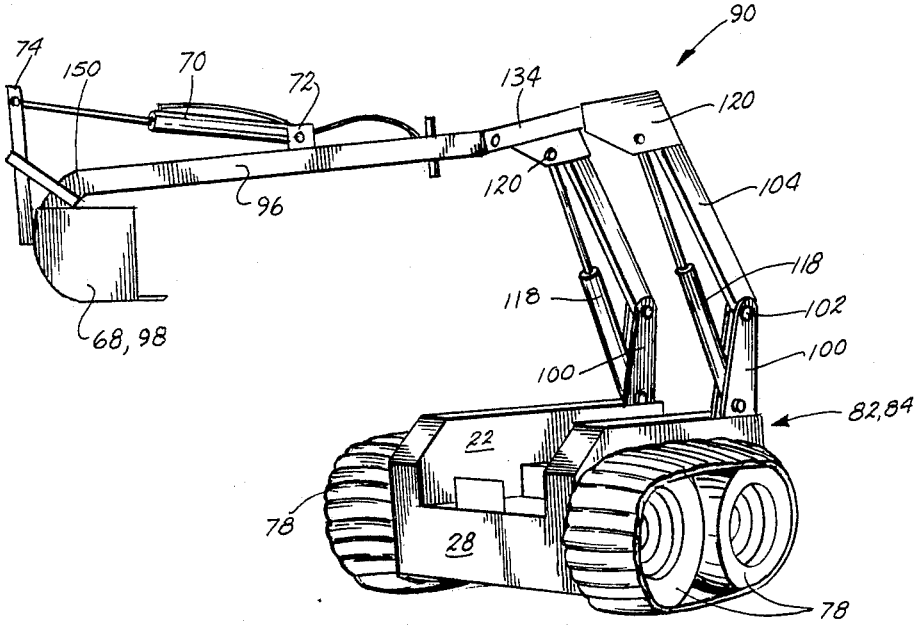
FIG. 6 is a perspective view of a tractor-mounted backhoe arrangement in accordance with the present invention, illustrating a typical elevated position of the backhoe assembly.

Thus, the resulting combination of the tractor 22, its associated boom arms 104, the dipper arm 96, and the bucket 68, together with the appropriate hydraulic actuators and controls, can be utilized as a backhoe. Referring finally to FIGS. 5 and 6, with the tractor 22 appropriately placed along the line of a planned excavation, the boom arms 104 are lowered and the dipper arm 96 extended with the bucket 68 positioned so as to form a downwardly directed concave cavity of the material holding portion of the bucket 68. Actuation of the boom extension cylinder and piston assemblies 126 is then commanded so as to cause the mounting bracket 122 to rotate about its horizontal axis 124, transverse to the tractor 22, thereby bringing the distal end 150 of the dipper arm 96, with the attached bucket 68, in a downward direction into engagement with the material to be excavated. When such engagement has progressed, the bucket positioning cylinder and piston assembly 70 is actuated to cause the open end of the bucket 68 to rotate toward the tractor 22. Substantially concurrently, the boom arm cylinder and piston assemblies 118 and the boom extension cylinder and piston assemblies 126 are actuated to cause the boom arms 104 to be controllably partially elevated and the distal end 150 of the dipper arm 96 to be drawn downwardly with respect to the mounting bracket 122 so as to draw the bucket 68 toward the tractor 22. When the bucket 68 has filled with material, a further rotation of the bucket 68 toward the tractor 22, by actuating the bucket positioning cylinder and piston assembly 70, is performed to place the open end of the bucket 68 into a more upwardly directed orientation in order to minimize any spilling of excavated material from within the bucket cavity during further operations. Then the boom arm cylinder and piston assemblies 118 may be actuated to further elevate the boom arms 104, thereby raising the dipper arm 96 and the bucket 68 above the surface of the ground surrounding the excavation.

If the excavated material is to be retained adjacent the excavation site, as is generally true for the prior art arrangement described earlier, the dipper swing cylinder and piston assembly 142 is actuated so as to translate the rack gear 148 in a manner that will cause the pinion gear 140, and the attached dipper arm 96, to be swung in the appropriate direction through an angle sufficient to place the bucket 68 over an area not within the excavation site, yet adjacent thereto. A maximum swing angle of ninety degrees to either side is attainable by the apparatus of the present invention. When the swing motion has been completed, the bucket positioning cylinder and piston assembly 70 is actuated to rotate the open end of the bucket 68 downwardly away from the tractor 22, which thereby dumps the material held therein onto the ground surface.

If the excavated material is to be placed into another vehicle for removal from the site, the other vehicle is first positioned adjacent either side of the tractor 22, the boom arm cylinder and piston assemblies 118 are actuated so as to raise the boom arms 104 substantially to their maximum elevation. Substantially concurrently, the boom extension cylinder and piston assemblies 126 are actuated so as to maintain the dipper arm 96 in a substantially horizontal attitude. The dipper swing cylinder and piston assembly 142 is then actuated appropriately to bring the bucket 68 to a position over the load-carrying portion of the second vehicle, whereat the bucket positioning cylinder and piston assembly 70 is actuated to dump the load from the bucket 68 into the second vehicle.

If the material is to be retained on the site, but in a position remote from the excavation, after the bucket 68 has been provided with the ground surface clearance as previously described, the boom arm cylinder and piston assemblies 118 and the boom extension cylinder and piston assemblies 126 are substantially concurrently actuated so as to place the boom arms 104 at substantially their maximum elevation while bringing the distal end 150 of the dipper arm 96 inwardly toward the tractor 22 to its essentially maximum inward position. In such configuration, which should provide clearance for the bucket 68 above the ground surface and which should not interfere with the front end 28 of the tractor 22, the tractor 22 may then be driven and maneuvered to a location whereat the excavated material is to be placed. The bucket positioning cylinder and piston assembly 70 is then actuated to dump the excavated material in the manner previously set forth.

As a further operational mode of the present invention, it is possible to perform channel clearing excavation by placing the bucket 68 into engagement with the surface of the ground and then dragging it along in that position as the tractor 22 is driven in reverse. Of course, such an operation may be combined with the above-described typical backhoe operation such that periodically the tractor 22 motion is stopped and an appropriate bucket 68 unloading sequence is performed.

It is also possible to perform some excavating operations in directions relative to the tractor 22 orientation other than directly in line with the tractor 22. By swinging the dipper arm 96 prior to lowering it so as to place the bucket 68 into engagement with the ground to be excavated, and then performing the combined bucket 68 rotation, boom arm 104 elevation, and dipper arm 96 depression operations, an off-axis excavation may be accomplished. Of course, since the boom arm 104 elevating motion causes the bucket 68 to have a motion component in a direction parallel with the longitudinal axis of the tractor 22, while the dipper arm 96 motions cause the bucket 68 to move in a line toward the tractor 22, some measure of interference will arise from the side wall of the bucket 68 being forced into unexcavated ground. The degree of interference will depend on the angle of swing of the dipper arm 96. Additionally some sideways tilting of the bucket 68 occurs with elevation of the boom arms 104 for swung positions of the dipper arm 96.

In all of the above operational modes, the tractor 22 provides sufficient stability from its own wheels or tracks since the load is lessened by the need for only one arm, the dipper arm 96, and by the fact that the load of the boom arms 104, the dipper arm 96, the bucket 68, and whatever load is carried by the bucket 68 are cantilevered from a support axis 102 at the rear of the tractor 22, thereby tending to keep the center of gravity of the combined supported load within the wheelbase of the tractor 22 in most instances.

In fabrication of the herein backhoe assembly 94 in accordance with the present invention, welding is the preferred manner of forming rigid attachments between elements when removability is not a consideration. All elements are to be formed of durable materials having sufficient structural strength to accomodate the anticipated loads within a reasonable margin of safety.

Thus, while preferred constructional features of the present invention are embodied in the arrangement illustrated and described herein, it is to be understood that changes and variations may be made by those skilled in the art without departing from the spirit and scope of the appended claims.

We claim:

1. A single-arm backhoe system, comprising:

a self-propelled tractor vehicle, having a front end, a rear end, opposed sides, at least four wheels supporting said tractor on the ground, and an operator's position thereon, said tractor further including an inherent pressurized hydraulic supply and controls therefor;

a boom arm assembly, pivotably supported at a first end thereof by at least one shaft forming a first pivot axis passing transversely of said tractor through at least one corresponding bracket rigidly affixed to said tractor proximate to said rear end thereof, said first pivot axis extending in a substantially horizontal direction transversely through said boom arm assembly at said first end thereof, said boom arm assembly extending from said first pivot axis in a cantilevered, non-interferring manner with respect to the structure of said tractor to at least one distal end of said boom arm assembly disposed proximate to said front end of said tractor;

a transverse structural member rigidly affixed to each of said at least one distal end of said boom arm assembly so as to be substantially horizontally disposed across and proximate to said front end of said tractor;

means for controllably pivoting said boom arm assembly including said transverse structural member in a substantially upward and downward direction about said first pivot axis;

a dipper arm assembly, having a first end thereof and a distal end thereof;

means, pivotably supported by said at least one distal end of said boom arm assembly and said transverse structural member, for pivotably supporting a first end of said dipper arm assembly in a manner enabling said dipper arm assembly to be rotated relative to said boom arm assembly and said transverse structural member about a substantially horizontal second pivot axis oriented transversely through said at least one distal end of said boom arm assembly such that said second pivot axis is substantially parallel to said transverse structural member, and enabling said dipper arm assembly to be rotated relative to said boom arm assembly about a substantially vertical third pivot axis through said first end of said dipper arm assembly;

means for controllably pivoting said dipper arm assembly in a generally upward and downward direction about said second pivot axis;

means for controllably pivoting said dipper arm assembly from side to side, relative to said tractor, about said third pivot axis;

an excavating bucket, pivotably supported from said distal end of said dipper arm assembly by a substantially horizontal shaft forming a fourth pivot axis oriented transverse to the extent of said dipper arm assembly; and means for controllably pivoting said bucket in a substantially upward and downward direction about said fourth pivot axis;

said tractor-mounted pressurized hydraulic supply and the controls associated therewith communicating operation and control of the several pivoting means of said backhoe system.

2. The single-arm backhoe system of claim 1, wherein said boom arm assembly comprises a pair of boom arms, mutually cantilevered from said first pivot axis and disposed such that each of said pair extends substantially parallel to its corresponding side of the tractor, with said transverse structural member being rigidly affixed between distal ends of said pair of boom arms, the span between said pair of boom arms being, in general, less than the span of the supporting wheels of said tractor, said pair of boom arms being constrained to pivot in unison about said first pivot axis.

3. The single-arm backhoe system of claim 2, wherein said means for controllably pivoting said pair of boom arms about said first pivot axis comprises a pair of hydraulic cylinder and piston rod assemblies, each of said pair being respectively pivotably coupled between a bracket rigidly affixed to said rear end of said tractor and a bracket rigidly affixed to the corresponding boom arm proximate to the distal end thereof.

4. A single-arm backhoe system, comprising:

a self-propelled tractor vehicle, having a front end, a rear end, opposed sides, at least four wheels supporting said tractor on the ground, and an operator's position thereon, said tractor further including an inherent pressurized hydraulic supply and controls therefor;

a boom arm assembly, pivotably supported at a first end thereof by at least one shaft forming a first pivot axis passing transversely of said tractor through at least one corresponding bracket rigidly affixed to said tractor proximate to said rear end of said tractor, said first pivot axis extending in a substantially horizontal direction transversely through said boom arm assembly at said first end thereof, said boom arm assembly comprising a pair of boom arms, mutually cantilevered from said first pivot axis and disposed such that each of said pair extends substantially parallel to its corresponding side of the tractor, the span between said pair of boom arms being, in general, less than the span of the supporting wheels of said tractor, said pair of boom arms being constrained to pivot in unison about said first pivot axis in a cantilevered, non-interferring manner with respect to the structure of said tractor, said boom arms further having distal ends disposed proximate to said front end of said tractor;

a transverse structural member rigidly affixed between said distal ends of said pair of boom arms;

a pair of hydraulic cylinder and piston assemblies, each of said pair being respectively pivotably coupled between a bracket rigidly affixed to a rear portion of said tractor and a bracket rigidly affixed to the corresponding boom arm proximate to the distal end thereof, said cylinder and piston assemblies being so adapted to controllably pivot said boom arm assembly in a substantially upward and downward direction about said first pivot axis;

a dipper arm assembly, having a first end thereof and a distal end thereof;

a horizontal transverse mounting bracket substantially spanning the separation between the distal ends of said boom arms, said mounting bracket being supported by a shaft extending along said second pivot axis, said shaft being supported from said transverse structural member rigidly coupled between said distal ends of said boom arms, said mounting bracket further comprising means for attaching said first end of said dipper arm assembly thereto;

means for pivotably supporting said dipper arm assembly from said mounting bracket enabling said dipper arm assembly to be rotated relative to said boom arm assembly about a substantially vertical third pivot axis through said first end of said dipper arm assembly;

means for controllably pivoting said dipper arm assembly in a generally upward and downward direction about said second pivot axis;

means for controllably pivoting said dipper arm assembly from side to side, relative to said tractor, about said third pivot axis;

an excvating bucket, pivotably supported from said distal end of said dipper arm assembly by a substantially horizontal shaft forming a fourth pivot axis oriented transverse to the extend of said dipper arm assembly; and means for controllably pivoting said bucket in a substantially upward and downward direction about said fourth pivot axis;

said tractor mounted pressurized hydraulic supply and the controls associated therewith communicating operation and control of the several pivoting means and hydraulic cylinder and piston assemblies of said backhoe system.

5. The single-arm backhoe system of claim 4, wherein said means for controllably pivoting said dipper arm assembly about said second pivot axis comprises a second pair of hydraulic cylinder and piston rod assemblies, each of said pair being respectively pivotably coupled between a bracket rigidly affixed to the corresponding boom arm at a point approximately above the front end of the tractor and a bracket rigidly affixed to said mounting bracket at a point near its transverse end proximate to the corresponding distal end of said boom arm.

6. The single-arm backhoe system of claim 5, wherein said means for pivotably supporting said dipper arm assembly enabling said dipper arm assembly to be rotated about said third pivot axis comprises:

a transverse matching bracket adapted to removably engage with said mounting bracket;

an upper dipper arm support bracket rigidly affixed to an upper surface of said matching bracket substantially centrally of the transverse extent of said matching bracket, said bracket extending from said matching bracket in a direction away from said tractor, said upper support bracket including a hole therethrough in a substantially vertical direction adapted to rotatably accept a shaft along said third pivot axis;

a lower dipper arm support bracket rigidly affixed to a lower surface of said matching bracket in a position and orientation such that said upper dipper arm support bracket and said lower dipper arm support bracket are essentially congruently parallel, with a hole formed in said lower dipper are support bracket, adapted to rotatably accept said shaft directed along said third pivot axis, aligned with the hole formed in said upper dipper arm support bracket; and a first end of said dipper arm, having said shaft rigidly coupled through said end in a generally upward and downward direction orthogonal to the extent of said dipper arm.

7. The single-arm backhoe system of claim 6, wherein said means for controllably pivoting said dipper arm assembly about said third pivot axis comprises:

a hydraulic cylinder and piston rod assembly disposed such that the cylinder of said assembly is rigidly coupled to said transverse matching bracket such that said piston rod is movable in a substantially horizontal direction parallel to the transverse extent of said matching bracket;

a rack gear forming a generally colinear extension of said piston rod; and a pinion gear rigidly coupled to said shaft forming said third pivot axis;

said rack gear and said pinion gear being mutually disposed so as to be in operable engagement, whereby linear translation of said rack gear will cause rotation of said pinion gear, thereby rotating said dipper arm about said third pivot axis.

8. The single-arm backhoe system of claim 7, wherein said means for controllably pivoting said bucket about said fourth pivot axis comprises a hydraulic cylinder and piston rod assembly pivotably coupled between a bracket rigidly affixed to said dipper arm assembly intermediate of the extent thereof and a bracket rigidly affixed to said bucket.

9. In a tractor-mounted backhoe system, wherein a tractor, having a front end, a rear end, opposed sides, an operator position thereon, and an associated hydraulic system and controls, is further equipped with a boom arm assembly consisting of:

a pair of boom arms pivotably cantilevered from brackets rigidly affixed to said rear end of said tractor, defining a first pivot axis, such that said boom arms respectively extend over and along corresponding sides of said tractor to distal ends of said boom arms depending from a point on each boom arm substantially above the front end of the tractor, said boom arms being generally constrained to pivot in unison about said first pivot axis in substantially vertical parallel planes parallel to the opposed sides of said tractor;

a pair of hydraulic cylinder and piston rod assemblies, each of said pair being respectively pivotably coupled between further brackets rigidly affixed to corresponding sides of said tractor proximate to said rear end thereof and brackets rigidly affixed to corresponding boom arms at points thereon proximate to the greatest elevated portion of said boom arms above said front end of said tractor, actuation of said cylinder and piston assemblies being supplied and controlled from said tractor-mounted hydraulic system and the associated controls therefor;

a transverse member rigidly affixed at opposed ends thereof to said distal ends of said boom arms, respectively;

a transverse mounting bracket, pivotably coupled to said transverse member such that said transverse mounting bracket may pivot about a second pivot axis extending substantially horizontally between said distal ends of said boom arms; and a second pair of hydraulic cylinder and piston rod assemblies, each of said pair being respectively pivotably coupled between brackets rigidly affixed to the corresponding boom arms substantially vertically above the front end of said tractor and brackets rigidly affixed to said transverse mounting bracket at points thereon proximate to the distal ends of the corresponding boom arms, actuation of said cylinder and piston assemblies being supplied and controlled from said tractor-mounted hydraulic system and the associated controls therefor;

the improvement comprising:

a transverse matching bracket adapted to removably engage with said transverse mounting bracket;

an upper dipper arm support bracket rigidly affixed to an upper surface of said matching bracket intermediate of the transverse extent of said matching bracket and extending therefrom in a direction away from said tractor, said upper dipper arm support bracket incorporating a hole therein adapted to rotatably accept a shaft;

a lower dipper arm support bracket rigidly affixed to a lower surface of said matching bracket so as to be congruently parallel with said upper dipper arm support bracket;

a first hydraulic cylinder and piston rod assembly, rigidly coupled to a forward surface of said transverse matching bracket such that the piston rod thereof may translate in a substantially horizontal direction transversely with respect to said tractor, actuation of said first cylinder and piston assembly being supplied and controlled from the tractor-mounted hydraulic system and the associated controls therefor;

a linear rack gear rigidly affixed to a distal end of said piston rod so as to form a substantially colinear extension thereof;

a dipper arm, having a first end and a distal end, said first end being adapted to be freely insertable and pivotable between said upper and said lower dipper arm support brackets;

a shaft, forming a third pivot axis, rigidly affixed to said first end of said dipper arm so at to extend therefrom in a substantially upward and downward direction relative to said dipper arm support brackets, said shaft being rotatably engaged by said holes in said dipper arm support brackets;

a pinion gear rigidly affixed to said shaft forming said third pivot axis so as to rotate therewith, said shaft and said pinion gear being appropriately configured and disposed such that said pinion gear is operably engaged with said rack gear, whereby horizontal translation of said rack gear, under actuation of said first cylinder and piston assembly, causes rotation of said pinion gear, its attached shaft, and the attached dipper arm, said rotation being generally from side to side with respect to said tractor;

a bucket pivotably attached to the distal end of said dipper arm so as to be capable of pivoting in a substantially upward and downward direction about a fourth pivot axis passing transversely horizontal through said distal end of said dipper arm; and a second hydraulic cylinder and piston rod assembly pivotably coupled between a bracket rigidly affixed to said dipper arm at a point intermediate of its extent and a bracket rigidly affixed to said bucket, actuation of said second cylinder and piston assembly being supplied and controlled from said tractor-mounted hydraulic system and the associated controls therefor.

10. In a tractor-mounted backhoe system, wherein a tractor, having a front end, a rear end, opposed sides, an operator position thereon, and an associated hydraulic system and controls, is further equipped with a boom arm assembly consisting of:

a pair of boom arms pivotably cantilevered from brackets rigidly affixed to said rear end of said tractor, defining a first pivot axis, such that said boom arms respectively extend over and along corresponding sides of said tractor to distal ends of said boom arms depending from a point on each boom arm substantially above the front end of the tractor, said boom arms being generally constrained to pivot in unison about said first pivot axis in substantially vertical parallel planes parallel to the opposed sides of said tractor;

a pair of hydraulic cylinder and piston rod assemblies, each of said pair being respectively pivotably coupled between further bracket rigidly affixed to corresponding sides of said tractor proximate to said rear end thereof and brackets rigidly affixed to corresponding boom arms at points thereon proximate to the greatest elevated portion of said boom arms above said front end of said tractor, actuation of said cylinder and piston assemblies being supplied and controlled from said tractor-mounted hydraulic system and the associated controls therefor;

a transverse member rigidly affixed at opposed ends thereof to said distal ends of said boom arms, respectively;

a transverse mounting bracket, pivotably coupled to said transverse member such that said transverse mounting bracket may pivot about a second pivot axis extending substantially horizontally between said distal ends of said boom arms; and a second pair of hydraulic cylinder and piston rod assemblies, each of said pair being respectively pivotably coupled between brackets rigidly affixed to the corresponding boom arms substantially vertically above the front end of said tractor and brackets rigidly affixed to said transverse mounting bracket at points thereon proximate to the distal ends of the corresponding boom arms, actuation of said cylinder and piston assemblies being supplied and controlled from said tractor-mounted hydraulic system and the associated controls therefor;

the improvement comprising:

means for adaptably mounting a backhoe assembly removably onto said transverse mounting bracket;

means for controllably pivoting a dipper arm and a bucket of said backhoe assembly from side to side relative to said tractor;

a dipper arm, supported at a first end thereof by said means for controllably pivoting the same;

a bucket, pivotably supported from a distal end of said dipper arm; and means for controllably pivoting said bucket in a generally upward and downward direction with respect to said dipper arm.

11. The improvement of claim 10, wherein said means for adaptably mounting a backhoe assembly onto said mounting bracket comprises:

a transverse matching bracket extending substantially horizontally across the span between said boom arms;

said matching bracket being adapted to removably engage with said mounting bracket so as to pivot in unison with said mounting bracket about its horizontal pivot axis;

said matching bracket including an upper dipper arm support bracket rigidly affixed to an upper surface of said matching bracket, and a lower dipper arm support bracket rigidly affixed to a lower surface of said matching bracket, said dipper arm support brackets being located intermediate of the transverse extent of said matching bracket and having a substantial surface extending from said matching bracket in a direction away from said tractor, said dipper arm support brackets being substantially mutually congruently parallel.

12. The improvement of claim 11, wherein said means for controllably pivoting said dipper arm and bucket from side to side relative to said tractor, comprises:

a first hydraulic cylinder and piston rod assembly disposed such that said cylinder is rigidly coupled to said matching bracket, on a forward facing surface thereof, in an orientation such that said piston is capable of linear translation along a substantially horizontal path parallel to the transverse extent of said matching bracket, said path passing through the region defined by said upper and said lower dipper arm support brackets, actuation of said cylinder and piston assembly being supplied and controlled from said tractor-mounted hydraulic system and the associated controls therefor;

a rack gear rigidly coupled to said piston rod at a distal end thereof so as to form a substantially colinear extension of said piston rod;

a shaft, extending through an end of said dipper arm obverse to that at which said bucket is disposed, said shaft being so oriented as to pass transversely, with respect to the extent of the dipper arm, through the dipper arm in a generally upward and downward direction, said shaft being rigidly coupled to said dipper arm, said shaft having an extent sufficient to rotatably engage coaxial bearing holes in said upper and said lower dipper arm support brackets; and a pinion gear, rigidly coupled to said shaft so as to rotate therewith, said pinion gear being so disposed when the aforesaid elements are assembled so as to operably engage with said rack gear.

13. The improvement of claim 12, wherein said means for controllably pivoting said bucket with respect to said dipper arm comprises a second hydraulic cylinder and piston rod assembly pivotably coupled between a bracket rigidly affixed to said dipper arm at a point intermediate of its extent and a bracket rigidly affixed to said bucket, actuation of said second cylinder and piston assembly being supplied and controlled from said tractor-mounted hydraulic system and the associated controls therefor.

14. The improvement of claim 13, wherein said tractor further comprises four supporting and motive wheels, respectively disposed at substantially the for corners of a horizontal planar area defined by the length and width of the tractor, and wherein the pair of wheels on each of the opposed sides of the tractor are respectively provided with an endless track semi-circumferentially engaging the front and rear wheels of the pair.

* * * * *